United States Patent [19]

Kagoshima

[11] 4,357,909

[45] Nov. 9, 1982

[54] FLUID HEATER WITH SPIRAL HOT GAS FLOW

[76] Inventor: Takashi Kagoshima, 5 Kita 7 Chome, Higashi 1 JYO, Sunagawa City, Hokaido, Japan

[21] Appl. No.: 234,383

[22] Filed: Feb. 13, 1981

[51] Int. Cl.[3] ..... F22B 7/04

[52] U.S. Cl. ..... 122/183; 122/13 R; 122/176; 122/17; 122/18

[58] Field of Search ..... 122/16–18, 122/44 B, 135 R, 135 F, 155 R, 155 A, 157, 158, 160, 162, 175, 176, 183, 184, 125, 126, 127

[56] References Cited

U.S. PATENT DOCUMENTS

| | | | |
|---|---|---|---|
| 257,139 | 4/1882 | Marmon | 122/155 A |
| 432,811 | 7/1890 | Young | 122/183 |
| 619,876 | 2/1899 | Dorgan | 122/183 |
| 631,261 | 8/1899 | Pattison | 122/183 |
| 687,735 | 12/1901 | Elmendorf | 122/183 |
| 722,703 | 3/1903 | Hang et al. | 122/183 |
| 851,985 | 4/1907 | Goldfein | 122/183 |
| 863,651 | 8/1907 | Rooch | 122/176 |
| 1,008,526 | 11/1911 | Cook | 122/166 |
| 1,090,512 | 3/1914 | Antonuccio | 122/18 |
| 1,528,845 | 3/1925 | Patterson | 122/176 |
| 2,814,278 | 11/1957 | Cameron | 122/17 |

*Primary Examiner*—Henry C. Yuen

*Attorney, Agent, or Firm*—William W. Haefliger

[57] ABSTRACT

A fluid heater embodies an upright shell with discs vertically arrayed in the shell interior. The discs are angled and configured induce spiral upward flow of hot gases, in external contact with the discs which themselves contain or pass fluid to be heated.

1 Claim, 7 Drawing Figures

FLUID HEATER WITH SPIRAL HOT GAS FLOW

BACKGROUND OF THE INVENTION

This invention relates generally to fluid heaters, and more particularly to high efficiency heaters.

There is a constant need for saving energy as by more efficient appliances such as fluid or water heaters. Also, there is a need for compact, low cost heater design, where multiple functions are performed by fewer heater parts.

SUMMARY OF THE INVENTION

It is a major object of the invention to meet the above need. Basically, the invention is embodied in a heater that comprises:

(a) a first upright shell having a lower interior in which fuel is combusted to produce hot gases that rise in the shell interior, and having an upper exhaust vent, (b) a series of hollow discs arranged generally vertically in the shell interior, with gases between the discs and the shell inner wall to pass the hot gases upwardly, (c) the discs tilted from horizontal and in multiple azimuthal directions to cause the hot gases to swirl in a spiral path as they flow upwardly between the discs and in said spaces, the discs having fluid inlets and outlets, and (d) means to pass fluid through the discs via said inlets and outlets, for heat transfer to the fluid in the discs.

As will appear, the need for spiral pipes is avoided through the provision of short support pipes for the basins and discs, with at least one pipe for each disc elevated relative to other support pipes, all the pipes operating to pass fluid between the discs and a chamber between outer and inner shells of the heater. The elevated pipes may be circularly staggered, vertically, whereby the discs are variably tilted for enhancing heat transfer by causing the hot rising gases to flow spirally between and about the discs, and against the inner side of the inner shell, as will appear.

These and other objects and advantages of the invention, as well as the details of an illustrative embodiment, will be more fully understood from the following specification and drawings, in which:

DETAILED DESCRIPTION

DETAILED DESCRIPTION

Figure 1:
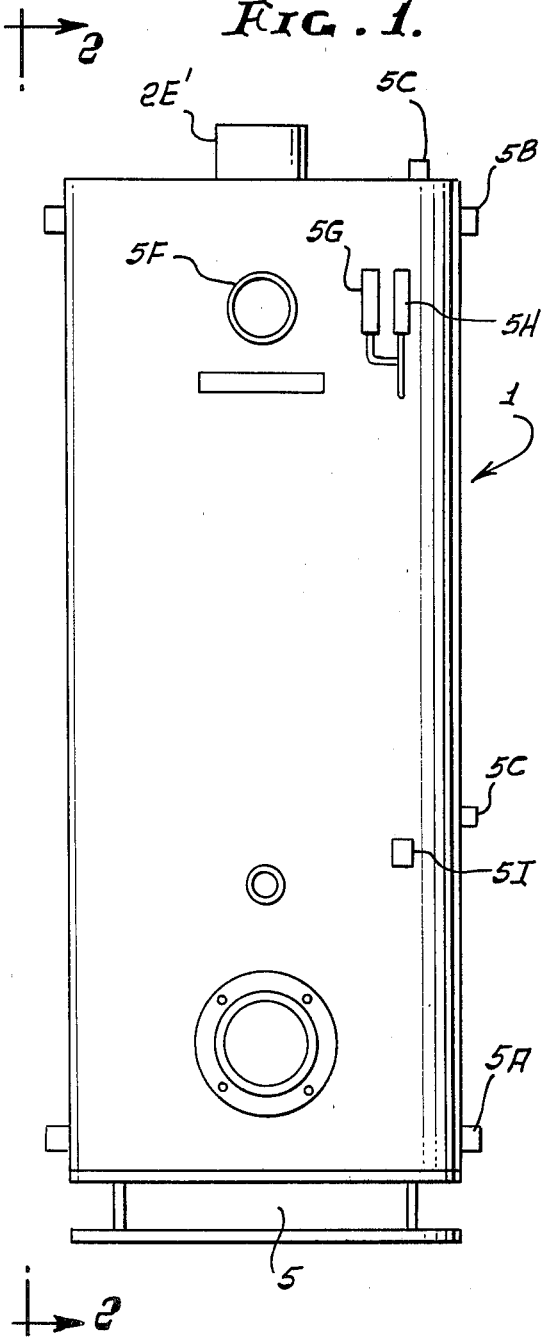
FIG. 1 is an elevation.

Referring to the drawings, an embodiment of the invention will now be explained in detail.

A fluid heater 1 according to the invention is constructed with an inner shell 2D consisting of cylindrical body 2A having top plate 2B and bottom plate 2C, on top and on bottom respectively. The inner shell is entirely surrounded by outer shell 8, a fluid chamber 2E being formed therebetween. Exhaust pipe 2E′ communicating with atmosphere is projected through the top plate 2B of the aforementioned inner shell and also through top plate 8B of outer shell. A burner hole 2F and inspection hole 2G are formed by lateral ducts 7A and 7B projecting through cylinders 2A and 8A at a lower part of the heater, to be projected outwards. Contained within inner shell 2D are basin-shaped fluid chambers or discs 4 in appropriate number, each having a prescribed gradient or tilt angle $\alpha$ (around five degrees) relative to horizontal, and leaving combustion chamber 2H in a lower region of the heater, as arranged.

Figure 4:
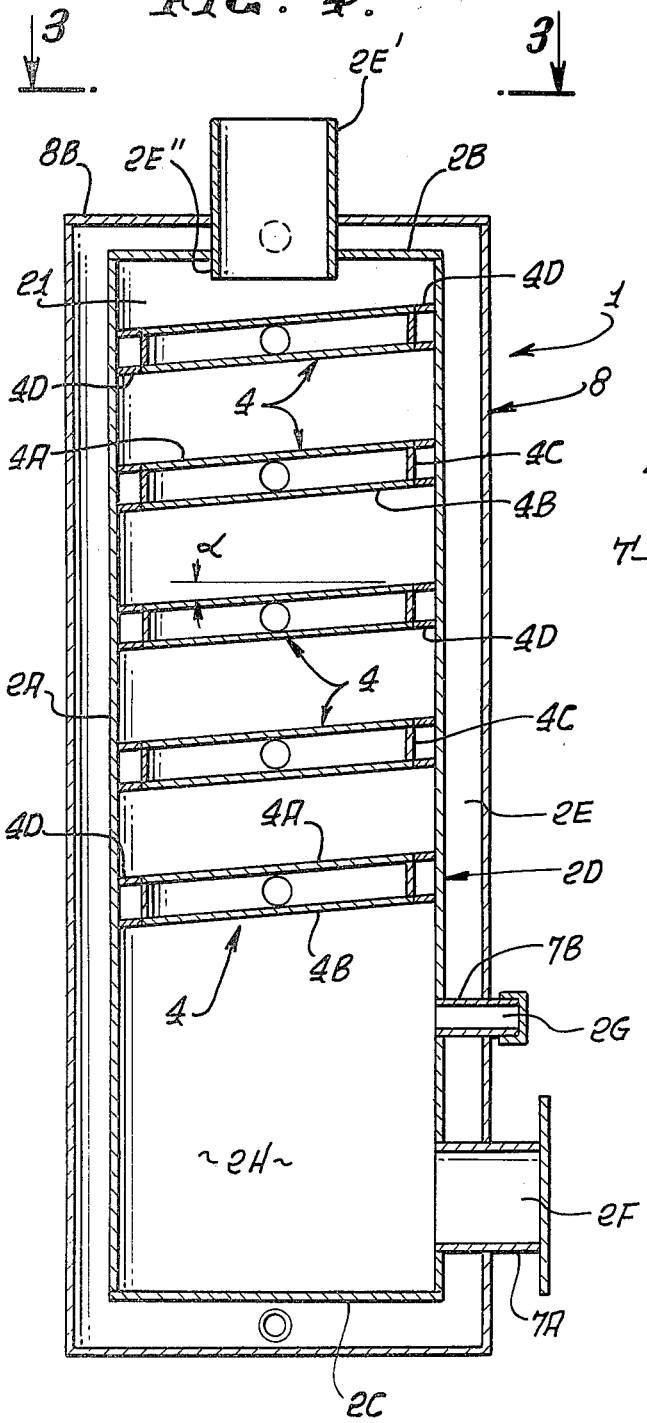
FIG. 4 is a vertical elevation, in section.
Figure 3:
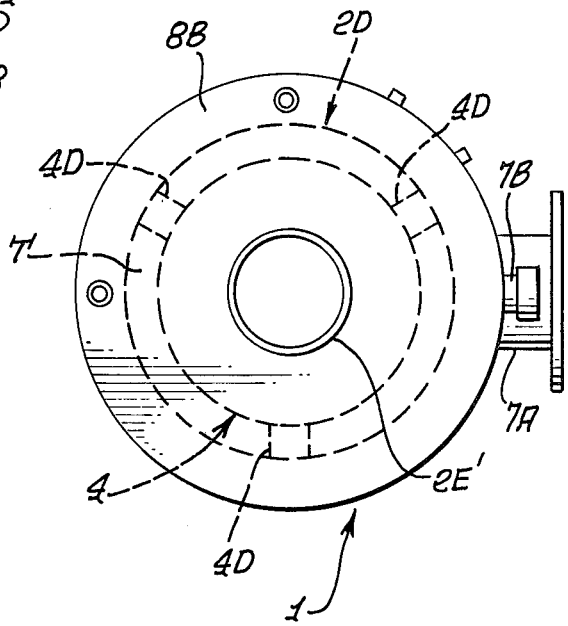
FIG. 3 is a plan view, on lines 3—3 of FIG. 4.
Figure 6:
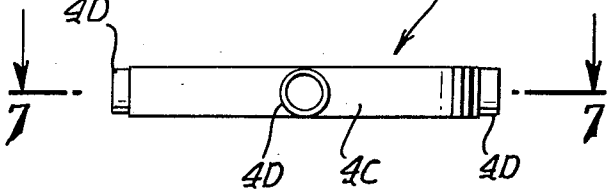
FIG. 6 is an elevation of a basin-shaped fluid chamber.
Figure 7:
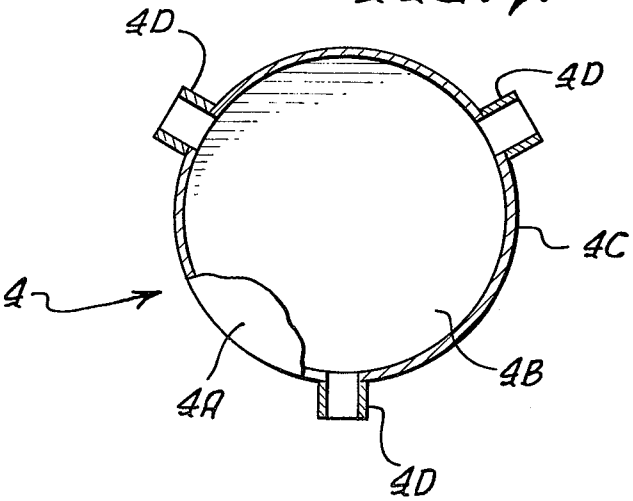
FIG. 7 is a sectional view taken on lines 7—7 of FIG. 6 of the above.

Each of the aforementioned basin-shaped fluid chambers 4, as seen in FIGS. 3, 4 and 7, has upper and lower round plates 4A and 4B smaller in diameter than the diameter of the inner shell 2D so as to be spaced therefrom. A side wall 4C in the shape of a short cylinder connects the round plates, and the side wall 4C and the inner shell 2A are connected by means of three connecting pipes 4D spaced about the fluid chambers 4.

The fitting positions of the connecting pipes 4D connecting the aforementioned individual basin-shaped fluid chambers with the inner shell (so as to conduct liquid such as water therebetween) are deviated or staggered relative to each other, slightly, as respects the basin-shaped fluid chambers located above and below. That is, the fitting positions are located successively spirally between the lowest basin-shaped fluid chamber and highest basin-shaped fluid chamber.

Figure 5:
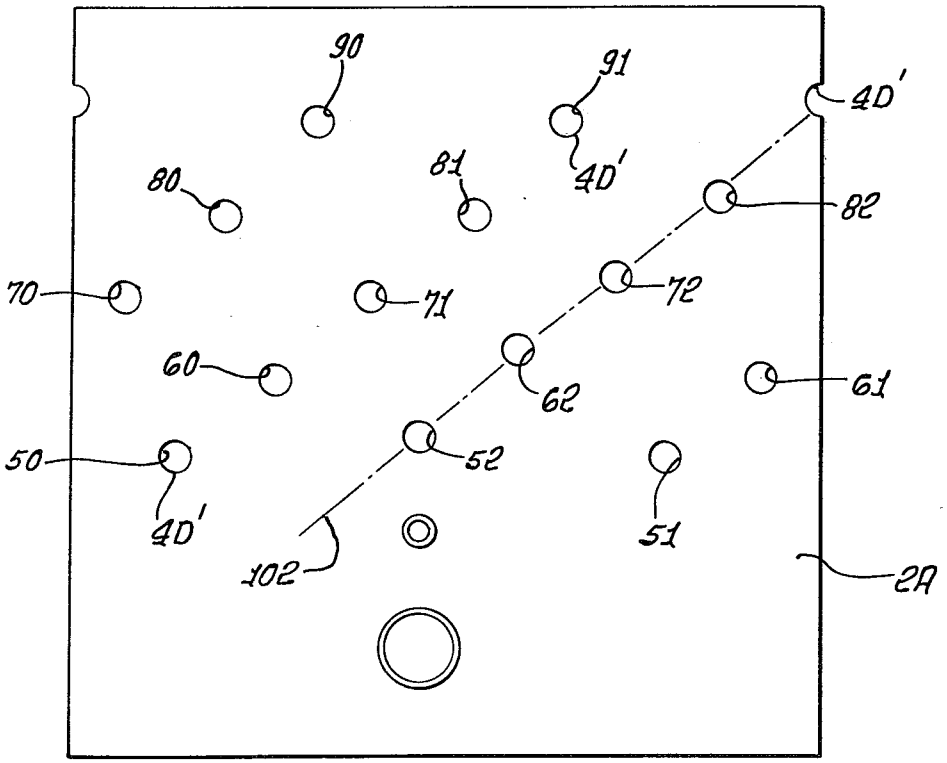
FIG. 5 is a plan view illustrating the development of side wall of inner shell.

A lower part 2E″ of the aforementioned exhaust pipe 2E′ is projected slightly into the inner shell as shown. 4D′ in FIG. 5 is a fitting hole in wall 2A for the connecting pipe 4D. 5 is a fluid heater base; 5A a fluid inlet and outlet communicating with the vertical annular chamber 2E; 5B a hot fluid outlet for chamber 2E for heating; 5C a hot fluid outlet of hot fluid feeding coil, 5D a kerosene burner, 5F a fluid thermometer, 5G a thermostat, 5H a height limit, 5I a thermal wall socket and 5J a safety valve, respectively.

With the invention constructed as described above, flames and heated air in the burning chamber inside the inner shell rise into contact with the basins and are ultimately exhausted into atmosphere. In such a case, heating is made in turn from a basin-shaped fluid chamber located below. Heated air is caused to pass through narrow ventilation flue T between the side wall of each basin-shaped fluid chamber and the inside wall of the inner shell; thus, the heated air expands immediately after passing through the ventilation flue and contacts the lower and upper surfaces of the disc-shaped fluid chambers of the basins located above and below the space between the chambers for heating. Inasmuch as the aforementioned individual basin-shaped fluid chambers are tilted, noise (so-called 'shooting sound') caused by boiling of fluid is prevented, and fluid movement such as rise of hot fluid occurs smoothly. Moreover, as the connecting pipes of the disc-shaped fluid chambers are staggered spirally, combustion flow spirals upwardly in a zig-zag manner and is discharged smoothly. Further, by projecting the lower part 2E″ of the exhaust pipe slightly into the inner shell, rising heated air or gas causes a weak accumulating phenomenon in the zone 21 for better heat transfer to the liquid between the shells. Since the side wall part of the inner shell, top part and bottom part are all contained by the outer shell with a fluid chamber therebetween, heat exchange is performed in all respects through the walls of the inner shell 2D, and through the walls of the basins 4.

As appears in FIG. 5, for each disc 4, two of the connecting pipes (as reflected by the positions of the corresponding holes 4D') are located at one elevation, and the third pipe is slightly elevated relative thereto. See the following table:

| | two lowest holes | elevated holes |
|---|---|---|
| lowest disc | 50 and 51 | 52 |
| next higher disc | 60 and 61 | 62 |
| next higher disc | 70 and 71 | 72 |
| next higher disc | 80 and 81 | 82 |
| highest disc | 90 and 91 | 92 |

Figure 2:
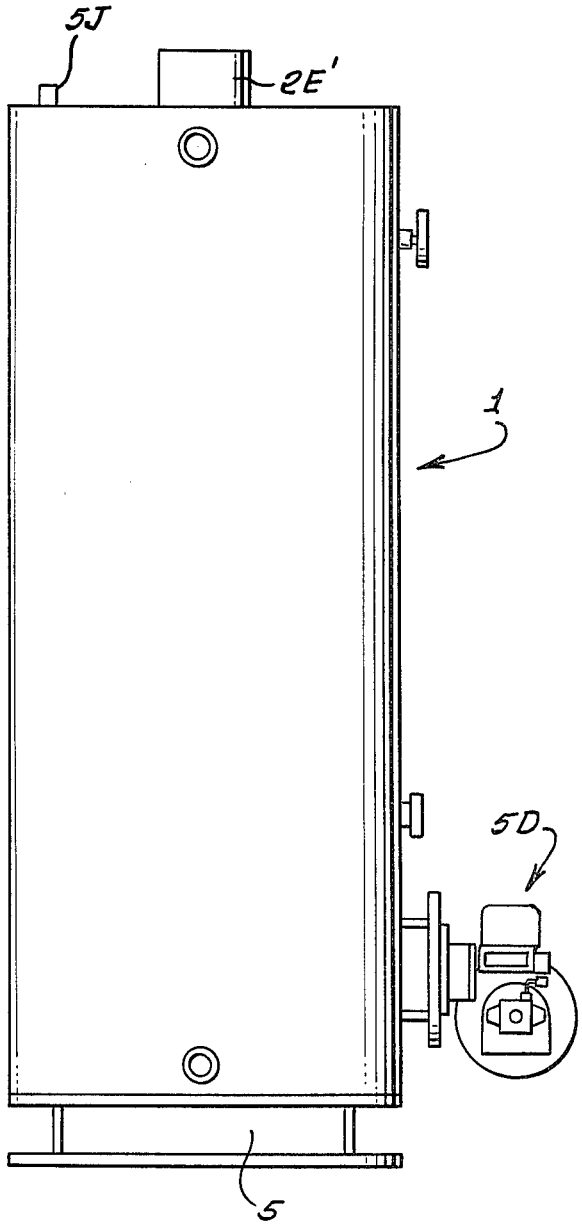
FIG. 2 is a left-side view, on lines 2—2 of FIG. 1.

Note that elevated holes are in upwardly angled alignment. (See line 102). Thus, the discs are tilted upwardly and in different azimuthal directions, enhancing the gas swirl effect (In FIGS. 2 & 4, all discs are shown as rotated about the vertical axis to illustrate their common upward tilt angularity),

I claim:

1. In a fluid heater, the combination comprising (a) a first upright shell having a lower interior in which fuel is combusted to produce hot gases that rise in the shell interior, and having an upper exhaust vent, (b) a series of like hollow, generally flat discs arranged generally vertically in the shell interior, with spaces between the entireties of all the discs and the shell inner wall to pass the hot gases upwardly, (c) the discs tilted from horizontal and in multiple azimuthal directions, the discs having fluid inlets and outlets, and (d) means to pass fluid through the discs via said inlets and outlets, for heat transfer to the fluid in the discs, said means comprising fluid passing tubes that also support the discs, the tubes supported by the shell, the tubes located radially outwardly of the discs, (e) there being three of said tubes for each disc and spaced thereabout, two of the three tubes being inlet tubes located at the same lower elevation and the third tube being an outlet tube located at a relatively higher elevation, the third tubes for the multiple discs being circularly staggered about an upright axis passing through the heater, whereby the hot gases are caused to flow upwardly between and around the edges of the tilted discs in a swirling zig-zag manner, the three tubes for each disc being equally spaced about said axis, all the flat discs tilted at about 5° from horizontal, (f) all three tubes for each tilted disc being everywhere in the same tilted plane as defined by the flat disc, there being an outer shell surrounding the first shell and spaced therefrom to form an annular fluid chamber therebetween, all the tubes communicating with said chamber which has a lower fluid inlet and an upper fluid outlet whereby said hot gas spiral flow passes adjacent the inner side of the first shell outwardly of the periphery of each tilted disc.

* * * * *